US011626260B2

(12) United States Patent
Fasano

(10) Patent No.: US 11,626,260 B2
(45) Date of Patent: Apr. 11, 2023

(54) CIRCUIT BREAKER WITH DOUBLE BREAK CONTACTS AND NON-POLARITY SENSITIVE DESIGN

(71) Applicant: Carling Technologies, Inc., Plainville, CT (US)

(72) Inventor: Michael Fasano, Watertown, CT (US)

(73) Assignee: Carling Technologies, Inc, Plainville, CT (US)

( * ) Notice: Subject to any disclaimer, the term of this patent is extended or adjusted under 35 U.S.C. 154(b) by 164 days.

(21) Appl. No.: 17/242,497

(22) Filed: Apr. 28, 2021

(65) Prior Publication Data

US 2022/0351919 A1 Nov. 3, 2022

(51) Int. Cl.

| | |
|---|---|
| ***H01H 73/18*** | (2006.01) |
| ***H01H 1/20*** | (2006.01) |
| ***H01H 33/08*** | (2006.01) |
| ***H01H 73/04*** | (2006.01) |
| ***H01H 33/59*** | (2006.01) |
| ***H01H 9/34*** | (2006.01) |
| ***H01H 9/44*** | (2006.01) |

(52) U.S. Cl.

CPC ..... *H01H 1/2083* (2013.01); *H01H 9/34* (2013.01); *H01H 9/443* (2013.01); *H01H 33/08* (2013.01); *H01H 33/596* (2013.01); *H01H 73/04* (2013.01); *H01H 73/18* (2013.01); *H01H 2205/002* (2013.01)

(58) Field of Classification Search

CPC .... H01H 1/2083; H01H 9/443; H01H 73/045; H01H 73/18

See application file for complete search history.

(56) References Cited

U.S. PATENT DOCUMENTS

| | | | |
|---|---|---|---|
| 4,684,772 | A | 8/1987 | Lehman |
| 5,163,175 | A | 11/1992 | Mori et al. |
| 8,822,866 | B2 | 9/2014 | Fasano |
| 9,406,465 | B1 | 8/2016 | Fasano |
| 10,002,721 | B1 | 6/2018 | Fasano |
| 10,211,003 | B1 | 2/2019 | Fasano |
| 10,236,136 | B1 | 3/2019 | Fasano |

OTHER PUBLICATIONS

International Search Report and Written Opinion dated Aug. 2, 2022 for PCT/US2022/026475 filed Apr. 27, 2022.

*Primary Examiner* — Ramon M Barrera
(74) *Attorney, Agent, or Firm* — KDB Firm PLLC

(57) ABSTRACT

A circuit interrupter includes a first set of contacts connected in series with a second set of contacts, with both sets of contacts configured to open and close simultaneously. First and second arc extinguishers are associated with the first and second sets of contacts, respectively. A moveable permanent magnet moves as the sets of contacts simultaneously open and close, the moveable magnet generating a moveable magnetic field, a first stationary permanent magnet associated with the first arc extinguisher, the first stationary magnet generating a first stationary magnetic field, where the first stationary magnetic field and the moveable magnetic field are additive, and a second stationary permanent magnet associated with the second arc extinguisher, the second stationary magnet generating a second stationary magnetic field, where the second stationary magnetic field and the moveable magnetic field are also additive.

22 Claims, 4 Drawing Sheets

CIRCUIT BREAKER WITH DOUBLE BREAK CONTACTS AND NON-POLARITY SENSITIVE DESIGN

FIELD OF THE INVENTION

The invention relates to the field of circuit interrupters, and more specifically, to a circuit interrupter having an improved arc extinguishing configuration that is adapted to rapidly extinguish an electrical arc regardless of the polarity of current through the circuit interrupter, as particularly relevant for use in direct current (DC) applications.

BACKGROUND OF THE INVENTION

Circuit interrupters are electrical components that are used to open an electrical circuit, interrupting the flow of current. A basic example of a circuit interrupter is a switch, which generally consists of two electrical contacts in one of two states; either closed, meaning that the contacts are in electrical contact with each other allowing electricity to flow between them, or open, meaning that the contacts are not in electrical contact with each other preventing the flow of electricity. A switch may be directly manipulated to provide a control signal to a system, such as a computer keyboard button, or to control power flow in a circuit, such as a light switch.

Another example of a circuit interrupter is a circuit breaker. A circuit breaker may be used, for example, in an electrical panel to limit the amount of current flowing through the electrical wiring. A circuit breaker is designed to protect an electrical circuit from damage caused by, for example, an overload, a ground fault or a short circuit. If a fault condition, such as a power surge, occurs in the electrical wiring, the breaker will trip. This will cause a breaker that was in an "on" position to flip to an "off" position and interrupt the flow of electrical power through the breaker. Circuit breakers are generally provided to protect the electrical wiring by limiting the amount of current transmitted through the wires to a level that will not damage them. Circuit breakers can also prevent destruction of the devices that may draw too much current.

A standard circuit breaker has a terminal connected to a source of electrical power, such as a power line electrically connected to the secondary of a power company transformer, and a second terminal electrically connected to the wires that the breaker is intended to protect. Conventionally, these terminals are referred to as the "line" and "load" respectively. The line is sometimes referred to as the input of the circuit breaker. The load is sometimes referred to as the output of the circuit breaker, which connects to the electrical circuit and components receiving the electrical power.

An individual protected device, such as a single air conditioner, may be directly connected to a circuit breaker. Alternatively, circuit breakers may also be used to protect the wiring feeding multiple devices that may be connected to the circuit via various electrical outlets (e.g., various devices in a room each plugged into an outlet all on the same circuit fed by the same circuit breaker).

In general, a traditional single pole circuit interrupter has two contacts positioned inside of a housing. The first contact is stationary and may be connected to either the line or the load. The second contact is movable with respect to the first contact, such that when the circuit breaker is in the "off" or "tripped" position, a gap exists between the first and second contact.

A problem with the above-described circuit interrupters arises when energized contacts are opened while under load. As the contacts separate, transitioning from a closed to an open position, or when the opposite occurs, an electric arc may be formed in the gap between the contacts. An electrical arc is a plasma discharge between two points that is caused by electrical current that ionizes gasses in the air between the two points.

The creation of an arc during transition of the contacts can result in undesirable effects that negatively affect the operation of the circuit interrupter, even potentially creating a safety hazard. These negative effects can also have adverse consequences on the functioning of the circuit interrupter.

One possible consequence is that the arc may short to objects inside the circuit interrupter and/or to surrounding objects, causing damage and presenting a potential fire or safety hazard.

Another consequence of arcing is that the arc energy damages the contacts themselves, causing some material to escape into the air as fine particulate matter. The debris that has been melted off of the contacts can migrate or be flung into the mechanism of the circuit interrupter, destroying the mechanism or reducing its operational lifespan.

Still another effect of arcing is due to the extremely high temperature of the arc (tens of thousands of degrees Celsius), which can impact the surrounding gas molecules creating ozone, carbon monoxide, and other dangerous compounds. The arc can also ionize surrounding gasses, potentially creating alternate conduction paths.

Because of these detrimental effects, it is very important to inhibit the creation of arcs to begin with and/or to quickly extinguish or quench arcs, if created, in order to prevent the above-described situations. Various techniques for inhibiting arc formation to begin with, and/or for improved arc extinguishing/quenching if arcs are indeed created, are known.

One known method for inhibiting the development of arcing when contacts are opened or closed in AC systems is to time the opening or closing as nearly as possible to the zero crossing. However, this method is not available for use in DC systems, as there is no zero crossing.

U.S. Pat. No. 10,002,721, assigned on its face to Carling Technologies, Inc., focusses instead on inhibiting arc formation in DC situations by providing two sets of contacts connected in series. The circuit interrupter is designed so that the first and second sets of contacts open and close simultaneously, such that the series connected sets of contacts generate a higher arc voltage during the interruption process because the arc voltage is proportionately increased relative to distance between the contacts. In the series connected arrangement, the distance between the contacts is doubled (i.e., the opening distance for both sets of contacts is additive), which in turn, functions to increase the arc voltage for breaking the arc more effectively. This results in less arcing, which reduces damage to the contacts and the surrounding equipment. Likewise, the reduction in arcing reduces the amount of gas and debris that is generated by unwanted arcing.

However, while U.S. Pat. No. 10,002,721 does provide for a reduction in arc formation, and while it does provide for basic arc extinguishing in the form of two sets of arc splitting plates, more may be done to ensure that any arcs that are created are urged into the arc splitting plates as quickly as possible for enhanced arc extinguishing.

Various techniques have also been developed for providing enhanced arc quenching. For example, U.S. Pat. Nos. 8,822,866 and 8,866,034, assigned on their faces to Carling Technologies, Inc., variously relate to the use of electromagnetic fields to guide an arc toward an arc splitter. However, generating an electromagnetic field to move an arc requires the use of power, and generates heat in the device.

In order to avoid these negative issues, it has been conceived to incorporate a permanent magnet into the circuit interrupter, which produces a magnetic field without requiring a supply of electricity. However, permanent magnets produce a magnetic field having a fixed direction with respect to the magnet. Thus, early solutions for guiding an arc into an arc path using a permanent magnet were circuit polarity dependent. This was due to the fact that a magnetic field produced by a fixed permanent magnet has a fixed direction. As such, the mechanism for magnetically guiding the arc into the path depended upon the direction the current was flowing through the circuit interrupter.

Polarity dependent solutions are highly undesirable in many situations, because if they are connected backwards (i.e., with polarity reversed as compared to the intended orientation), the permanent magnet(s) will, instead of urging a created arc into the arc quencher, urge an arc away therefrom, and potentially into internal components of the circuit interrupter instead.

U.S. Pat. No. 9,406,465 and 10,211,003, both assigned on their faces to Caning Technologies, Inc., are focused on providing circuit interrupters having enhanced arc extinguishing functionality that operate to arrest an arc between the circuit interrupter contacts regardless of the polarity of the circuit. In particular, both of these patents disclose configurations that employ at least one permanent magnet arranged such that if an arc develops, the arc is driven into a first arc path when a polarity of the first, moveable contact is positive and the arc is driven into a second arc path when a polarity of the first, moveable contact is negative. However, no provision is made in either of these patents for the provision of two sets of contacts.

It is therefore desired to provide a circuit interrupter having an arc extinguishing configuration that is polarity independent (in that it functions equally well regardless of the polarity of current through the circuit interrupter) and that is adapted to both inhibit arc creation in the first place and to rapidly extinguish any electrical arc that is indeed created.

SUMMARY OF THE INVENTION

To this end, a circuit interrupter is provided, according to one aspect of the present invention, comprising a first set of contacts including a first contact and a second contact, movable into and out of contact with each other, and a second set of contacts including a third contact and a fourth contact, movable into and out of contact with each other. The first set of contacts is connected in series with the second set of contacts, and the first set of contacts is configured to open and close simultaneously with opening and closing of the second set of contacts. A first arc extinguisher is associated with the first set of contact and a second arc extinguisher is associated with the second set of contacts. At least three permanent magnets are provided, comprising a moveable permanent magnet that moves as the first set of contacts and the second set of contacts simultaneously open and close, the moveable magnet generating a moveable magnetic field, a first stationary permanent magnet associated with the first arc extinguisher, the first stationary magnet generating a first stationary magnetic field, wherein the first stationary magnetic field and the moveable magnetic field are additive with respect to each other, and a second stationary permanent magnet associated with the second arc extinguisher, the second stationary magnet generating a second stationary magnetic field, wherein the second stationary magnetic field and the moveable magnetic field are additive with respect to each other.

In some embodiments, the circuit interrupter comprises a DC circuit interrupter having a DC voltage passing therethrough. In certain of these embodiments, the first arc extinguisher comprises a first set of arc splitting plates and a second set of arc splitting plates and wherein the second arc extinguisher comprises a third set of arc splitting plates and a fourth set of arc splitting plates.

In certain embodiments, when an arc occurs between the first set of contacts, the first stationary magnetic field and the moveable magnetic field urge the arc off of the first set of contacts and toward either the first set of arc splitting plates or the second set of arc splitting plates depending on a polarity of the DC voltage, and when an arc occurs between the second set of contacts, the second stationary magnetic field and the moveable magnetic field urge the arc off of the second set of contacts and toward either the third set of arc splitting plates or the fourth set of arc splitting plates depending on the polarity of the DC voltage.

In certain embodiments, the first stationary permanent magnet is positioned between the first set of arc splitting plates and the second set of arc splitting plates. In certain of these embodiments, a shield is disposed between the first stationary permanent magnet and the first set of contacts.

In certain embodiments, the second stationary permanent magnet is positioned between the third set of arc splitting plates and the fourth set of arc splitting plates. In certain of these embodiments, a shield is disposed between the second stationary permanent magnet and the second set of contacts.

In some embodiments, the circuit interrupter further comprises a moveable contact arm on which are positioned the first contact and the third contact. In certain of these embodiments, the moveable contact arm comprises a first end and a second end and the first contact is positioned toward the first end and the third contact is positioned toward the second end. In certain of these embodiments, the moveable magnet is positioned on the moveable contact arm between the first contact and the third contact.

In some embodiments, the first arc extinguisher comprises a first arc runner positioned in the vicinity of the first set of contacts and the second arc extinguisher comprises a second arc runner positioned in the vicinity of the second set of contacts.

In some embodiments, the circuit interrupter comprises a circuit breaker, and an overcurrent measurement device is configured to open the first set of contacts and the second set of contacts in response to detection of an overcurrent situation.

In some embodiments, the circuit interrupter further comprises an actuator, manipulation of which is adapted to open and/or close the first set of contacts and the second set of contacts.

In some embodiments, the circuit interrupter further comprises a housing configured to be detachably connectable to a DIN rail.

In accordance with another aspect of the present invention, a DC circuit breaker adapted to selectively interrupt a DC voltage passing therethrough comprises a moveable contact arm having a first end and a second end, a first set of contacts including a first contact and a second contact, movable into and out of contact with each other, the first contact being positioned on the moveable contact arm toward the first end thereof, and a second set of contacts including a third contact and a fourth contact, movable into and out of contact with each other, the third contact being positioned on the moveable contact arm toward the second end thereof. The first set of contacts is connected in series with the second set of contacts, and the first set of contacts is configured to open and close simultaneously with opening and closing of the second set of contacts by virtue of movement of the moveable contact arm. A first arc extinguisher is associated with the first set of contacts, the first arc extinguisher comprising a first set of arc splitting plates and a second set of arc splitting plates, and a second arc extinguisher is associated with the second set of contacts, the second arc extinguisher comprising a third set of arc splitting plates and a fourth set of arc splitting plates. At least three permanent magnets are provided, comprising a moveable permanent positioned on the moveable contact arm between the first contact and the third contact, the moveable magnet generating a moveable magnetic field, a first stationary permanent magnet associated with the first arc extinguisher, the first stationary magnet generating a first stationary magnetic field, wherein the first stationary magnetic field and the moveable magnetic field are additive with respect to each other, and wherein when an arc occurs between the first set of contacts, the first stationary magnetic field and the moveable magnetic field urge the arc off of the first set of contacts and toward either the first set of arc splitting plates or the second set of arc splitting plates depending on a polarity of the DC voltage, and a second stationary permanent magnet associated with the second arc extinguisher, the second stationary magnet generating a second stationary magnetic field, wherein the second stationary magnetic field and the moveable magnetic field are additive with respect to each other, and wherein when an arc occurs between the second set of contacts, the second stationary magnetic field and the moveable magnetic field urge the arc off of the second set of contacts and toward either the third set of arc splitting plates or the fourth set of arc splitting plates depending on the polarity of the DC voltage.

In some embodiments, the first stationary permanent magnet is positioned between the first set of arc splitting plates and the second set of arc splitting plates and the second stationary permanent magnet is positioned between the third set of arc splitting plates and the fourth set of arc splitting plates. In certain of these embodiments, a first shield is disposed between the first stationary permanent magnet and the first set of contacts and a second shield is disposed between the second stationary permanent magnet and the second set of contacts.

In some embodiments, the first arc extinguisher comprises a first arc runner positioned in the vicinity of the first set of contacts and the second arc extinguisher comprises a second arc runner positioned in the vicinity of the second set of contacts.

In some embodiments, an overcurrent measurement device is configured to open the first set of contacts and the second set of contacts in response to detection of an overcurrent situation. In certain of these embodiments, an actuator is provided, manipulation of which is adapted to open and/or close the first set of contacts and the second set of contacts. In some embodiments, the DC circuit breaker further comprises a housing configured to be detachably connectable to a DIN rail.

The present invention thus provides a circuit interrupter having an arc extinguishing configuration that is polarity independent (in that it functions equally well regardless of the polarity of current through the circuit interrupter) and that is adapted to both inhibit arc creation in the first place and to rapidly extinguish any electrical arc that is indeed created.

Other objects of the invention and its particular features and advantages will become more apparent from consideration of the following drawings and accompanying detailed description.

DETAILED DESCRIPTION OF THE INVENTION

Figure 1:
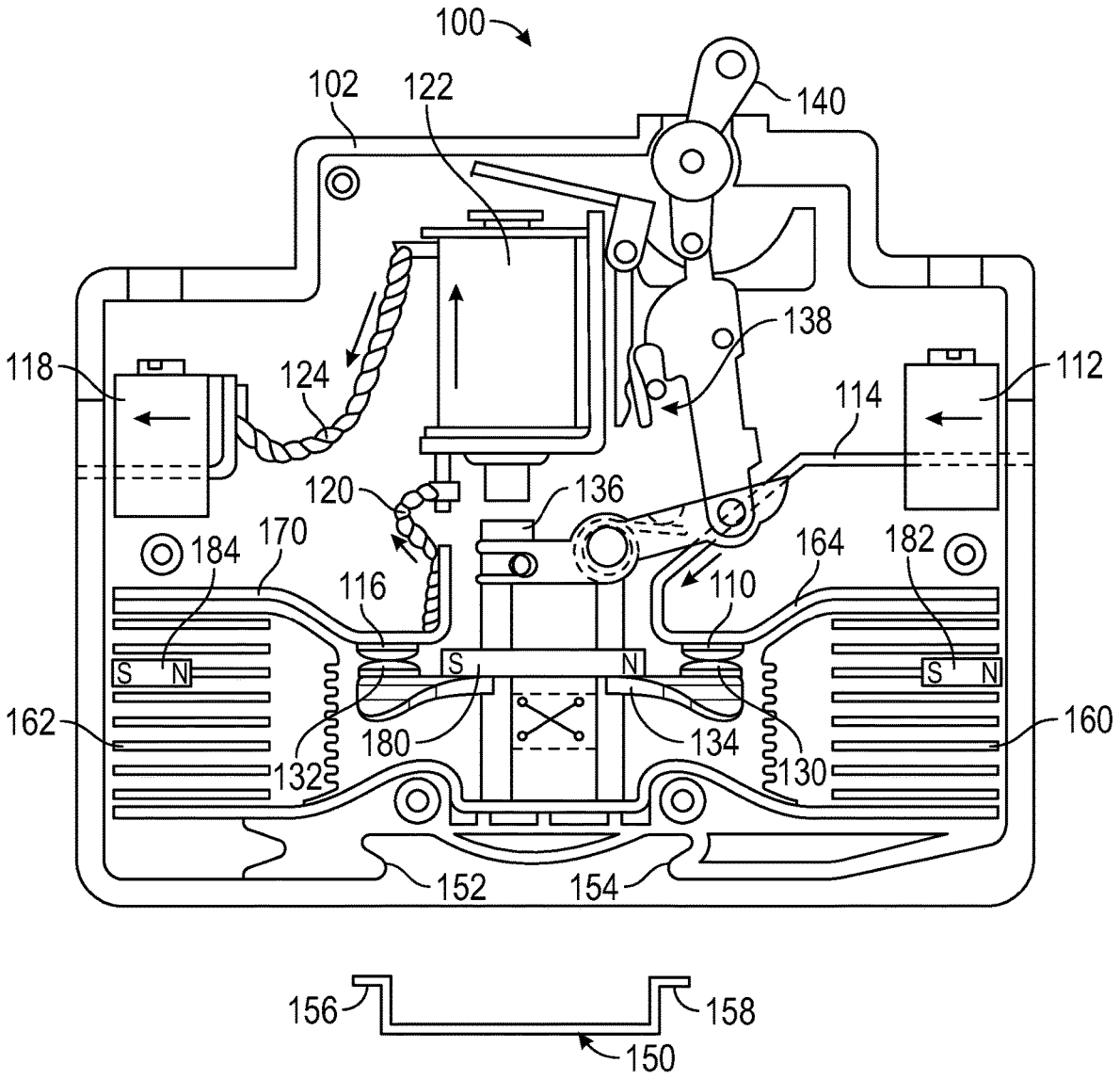
FIG. 1 a side elevational view, partially broken away, of an exemplary circuit interrupter, in the form of a circuit breaker, constructed in accordance with the present invention.

Referring now to the drawings, wherein like reference numerals designate corresponding structure throughout the views, FIG. 1 illustrates components of an example circuit interrupter (100) having multiple contacts according to aspects of the invention.

The circuit interrupter (100) may be any device which can be used to make and break a circuit using contacts. For example, it will be clear to those having ordinary skill in the art that circuit interrupter (100) may be a simple switch, or may be implemented, as shown in the Figures, as a circuit breaker having a housing (102), for example. Housing (102) may include vents to allow gasses and debris produced by arcing to escape housing (102).

Circuit interrupter (100) includes a first stationary contact (110), that is electrically connected to a line terminal (112) through a conductor (114), and a second stationary contact (116) that is electrically connected to a load terminal (118) through a flexible conductor (120), an overcurrent measurement device (122) and another flexible conductor (124).

The line terminal (112) receives electricity from a power source, such as a generator (not shown), which in some applications is supplied by a power company, solar panels, a battery bank, or some other source.

Circuit interrupter (100) further includes a first moveable contact (130) and a second moveable contact (132), both of which are mounted on opposing sides of moveable contact arm (134). Contact arm (134) is, in turn, connected to contact arm carrier (136), which itself is further connected to linkage assembly (138) and actuated by handle (140). First movable contact (130) and second moveable contact (132) are electrically connected in series with each other.

The exemplary embodiment shown is particularly adapted for use in connection with a DIN (Deutsches Institut far Normung) rail system, although such is not required. To this end, the bottom of housing (102) is shown configured to be mounted to DIN rail (150). For example, the bottom of housing (102) is shown with a first protrusion (152) and a second protrusion (154) that are designed to engage with opposing edges (156, 158) of DIN rail (150).

Although many configurations are known for DIN rail engagement, in this shown relatively simple example, protrusion (152) is designed to be deformable such that protrusion (154) may be engaged with edge (158), then the housing (102) can be rotated downward such that protrusion (152) comes into physical contact with edge (156). With the application of downward force, the protrusion (152) deflects inward until protrusion (152) passes below edge (156) at which time protrusion (152) again deflects outward and engages with edge (156) to firmly affix housing (102) to DIN rail (150). This makes for an easy to connect/disconnect circuit interrupter (100) that can be mounted anywhere a DIN rail (150) is mounted.

In FIG. 1, the contact arm (134) is shown in the closed position in which first stationary contact (110) is physically contacting first movable contact (130), and second stationary contact (116) is physically contacting second movable contact (132). Thus, when contact arm (134) is in this shown closed position, electricity can flow between line terminal (112) and load terminal (118).

Moreover, the assembly is provided such that, when contact arm carrier (136) is displaced downward, contact arm (134) travels downward to break or open the contacts (i.e., there is a gap between first stationary contact (110) and first movable contact (130), and between second stationary contact (116) and second movable contact (132)). The system is configured so that the connection between first stationary contact (110) and first movable contact (130) is opened simultaneously with the opening of second stationary contact (116) and second movable contact (132).

Contact arm (134) may be actuated via a switch, such as handle (140), overcurrent measurement device (122), and/or any other known mechanism (not shown) depending on the desired implementation of circuit interrupter (100).

Overcurrent measurement device (122) may be any type of device for measuring current that passes through the circuit interrupter (100). Once a maximum current is reach, the measurement device will function to cause the contact arm (134) to move to an open position. Likewise, the handle (140) will move to an intermediate position to indicate a "tripped" state of circuit interrupter (100). As is known, the handle (140) can then be used to "reset" the circuit interrupter (100), by causing the contact arm (134) to move to its closed position, wherein current is again allowed to flow.

Also illustrated in FIG. 1 is a first arc extinguisher (160) that is associated with the first set of contacts (110, 130) and a second arc extinguisher (162) that is associated with the second set of contacts (116, 132).

Figure 2:
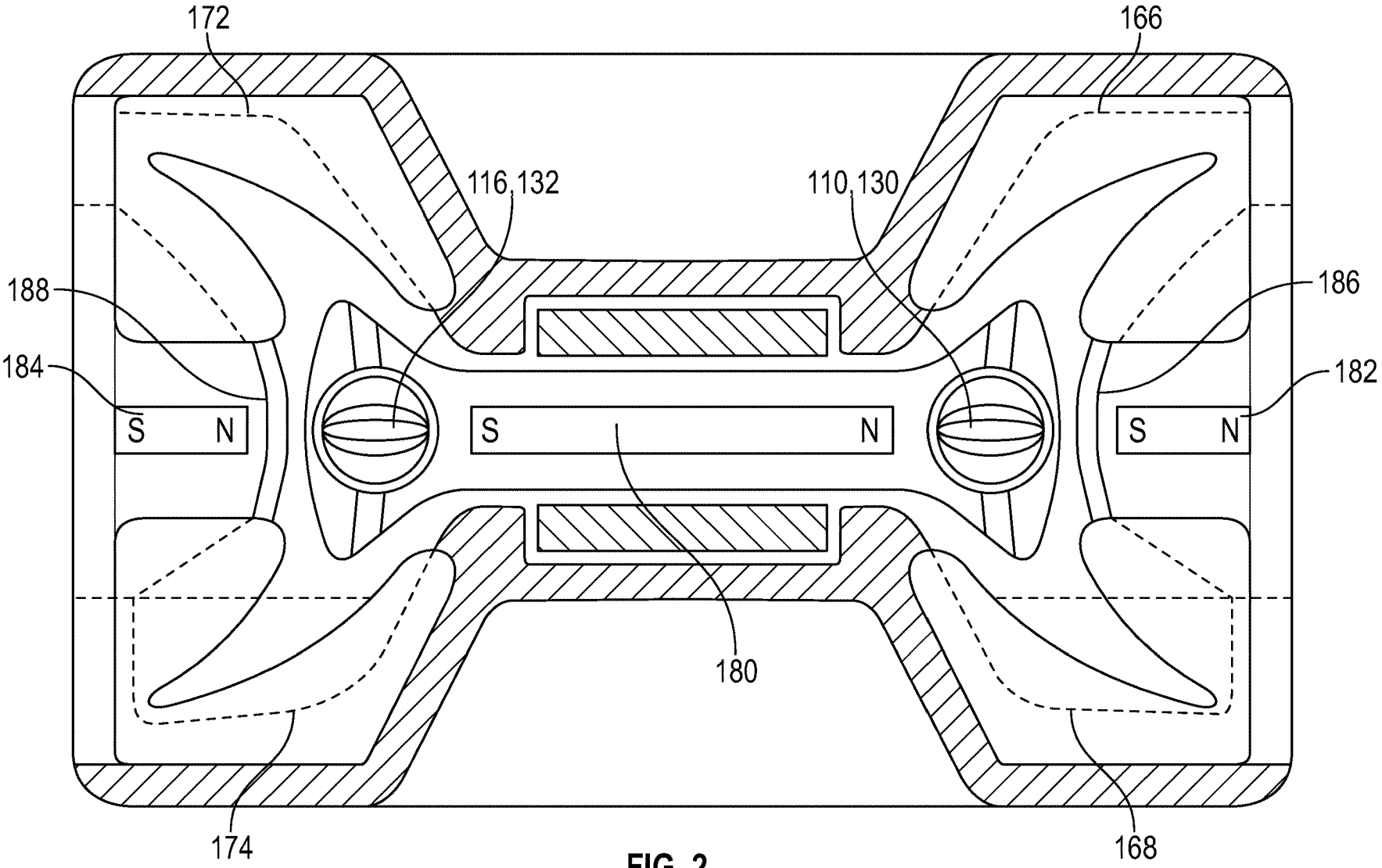
FIG. 2 is a top plan view, partially broken away, of the exemplary circuit interrupter, in the form of a circuit breaker, constructed in accordance with the present invention as shown in FIG. 1.

First arc extinguisher (160) includes a first arc runner (164) (best seen in FIG. 1) positioned at least partially in the vicinity of the first set of contacts (110, 130) and further includes a first set of arc splitting plates (166), and a second set of arc splitting plates (168) (best seen in FIG. 2) that are configured to catch any arcs created between the first set of contacts (110, 130), as described more fully below. As best seen in FIG. 1, each of set of arc splitting plates (166, 168) comprises a number of spaced apart arc splitting plates (eight are shown), and as best seen in FIG. 2, the first set of arc splitting plates (166) and the second set of arc splitting plates (168) are disposed on opposite sides of the first set of contacts (110, 130), for purposes discussed below.

Similarly, second arc extinguisher (162) includes a second arc runner (170) (best seen in FIG. 1) positioned at least partially in the vicinity of the second set of contacts (116, 132) and further includes a third set of arc splitting plates (172), and a fourth set of arc splitting plates (174) (best seen in FIG. 2) that are configured to catch any arcs created between the second set of contacts (116, 132), as described more fully below. As best seen in FIG. 1, each of set of arc splitting plates (172, 174) comprises a number of spaced apart arc splitting plates (eight are shown), and as best seen in FIG. 2, the third set of arc splitting plates (172) and the fourth set of arc splitting plates (174) are disposed on opposite sides of the second set of contacts (116, 132), for purposes discussed below.

The circuit interrupter (100) is designed such that the first set of contacts (110, 130) and the second set of contacts (116, 132) open and close simultaneously. The electrical current that passes through the circuit breaker will travel sequentially through the first set of contacts (110, 130) and second set of contacts (116, 132) (arrows are shown in FIG. 1 for illustrative purposes only to illustrate the current path). As generally recognized, DC power sources require the arc voltage to be at least 1.2 to 1.5 times the source voltage to interrupt the DC fault current. The series connected sets of contacts generates a higher arc voltage during the interruption process because the arc voltage is proportionately increased relative to distance between the contacts. In the series connected arraignment, the distance between the contacts is doubled (i.e., the opening distance for both sets of contacts is additive), which in turn, functions to increase the arc voltage for breaking the arc more effectively. This results in less arcing, which reduces damage to the contacts and the surrounding equipment. Likewise, the reduction in arcing will reduce the amount of gas and debris that is generated by unwanted arcing.

Nevertheless, arcing may still occur, particularly in relatively high power situations. Thus, the present invention, in addition to providing for arc inhibition, also provides for enhanced arc quenching.

To this end, a plurality of permanent magnets are provided and strategically disposed and oriented. More specifically, a moveable permanent magnet (180) is disposed on the contact arm (134) between the moveable contacts (130, 132), such that the moveable permanent magnet (180) moves as the first set of contacts (110, 130) and the second set of contacts (116, 132) simultaneously open and close by virtue of movement of the contact arm (134). The moveable permanent magnet (180) generates a moveable magnetic field, and is oriented, in the example shown, such that the north pole thereof faces to the right and the south pole thereof faces to the left, with respect to the orientation illustrated in FIGS. 1 and 2.

A first stationary permanent magnet (182) is disposed in the vicinity of, and is associated with, the first arc extinguisher (160). More specifically, in the example shown, the first stationary permanent magnet (182) is positioned between the first set of arc splitting plates (166) and the second set of arc splitting plates (168) (best seen in FIG. 2). Moreover, the first stationary permanent magnet (182) generates a first stationary magnetic field which is additive with respect to the moveable magnetic field created by the moveable permanent magnet (180). What is meant by this is that the first stationary permanent magnet (182) is, like the moveable permanent magnet (180), oriented such that the north pole thereof faces to the right and the south pole thereof faces to the left, with respect to the orientation illustrated in FIGS. 1 and 2. Thus, the south pole of the first stationary permanent magnet (182) and the north pole of the moveable permanent magnet (180) face each other across the gap between the first set of contacts (110, 130), when opened (as best seen in FIG. 2).

Similarly, a second stationary permanent magnet (184) is disposed in the vicinity of, and is associated with, the second arc extinguisher (162). More specifically, in the example shown, the second stationary permanent magnet (184) is positioned between the third set of arc splitting plates (172) and the fourth set of arc splitting plates (174) (best seen in FIG. 2). Moreover, the second stationary permanent magnet (184) generates a second stationary magnetic field which is additive with respect to the moveable magnetic field created by the moveable permanent magnet (180). What is meant by this is that the second stationary permanent magnet (184) is, like the moveable permanent magnet (180), oriented such that the north pole thereof faces to the right and the south pole thereof faces to the left, with respect to the orientation illustrated in FIGS. 1 and 2. Thus, the north pole of the second stationary permanent magnet (184) and the south pole of the moveable permanent magnet (180) face each other across the gap between the second set of contacts (116, 132), when opened (as best seen in FIG. 2).

As best seen in FIG. 2, a shield (186) is preferably disposed between the first stationary permanent magnet (182) and the first set of contacts (110, 130), and a shield (188) is preferably disposed between the second stationary permanent magnet (184) and the second set of contacts (116, 132). The purpose of the shields (186, 188) is to protect the first and second stationary permanent magnets (182, 184) from arcs, or materials generated by arcs, created between the contacts.

Figure 3:
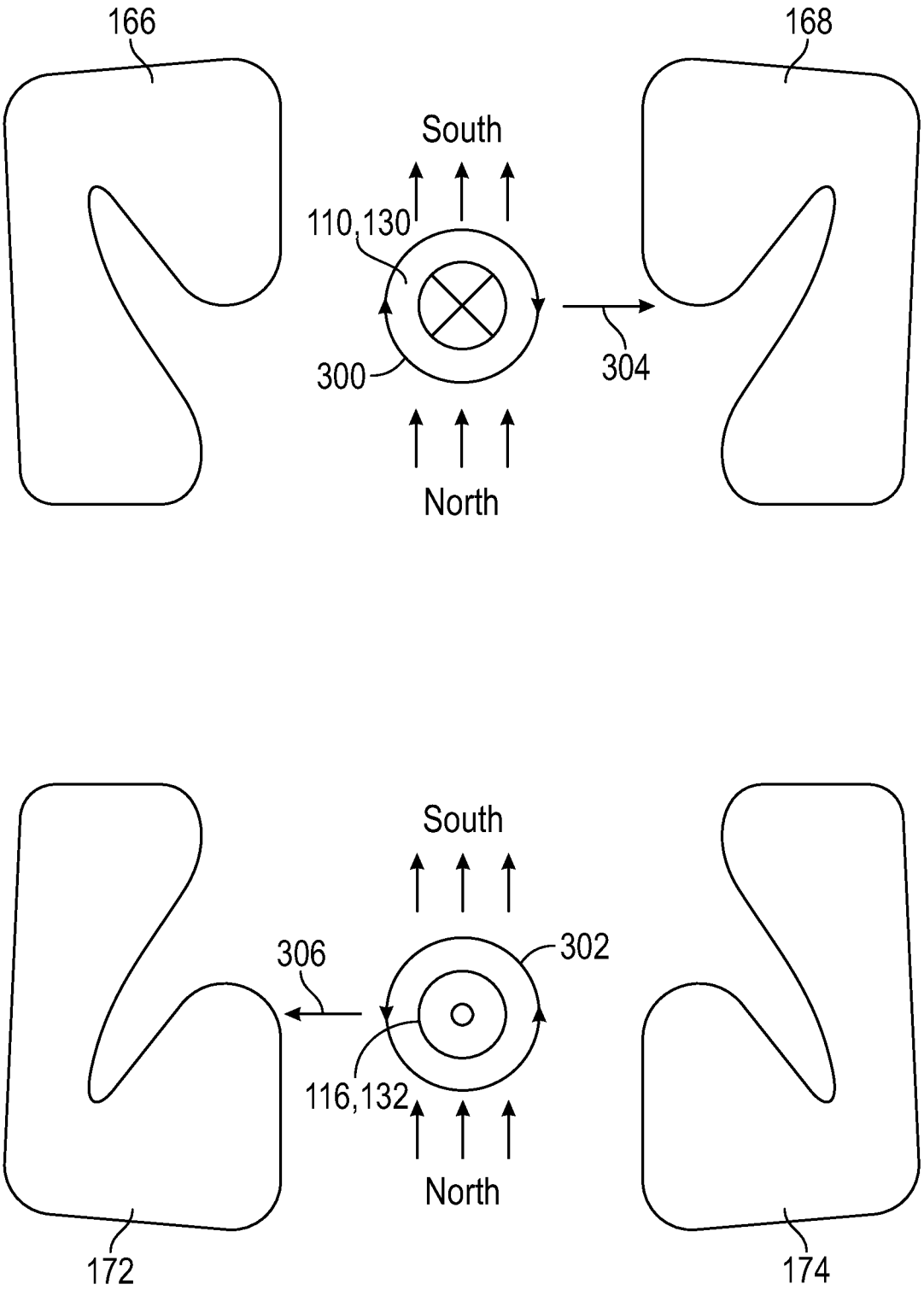
FIG. 3 is a schematic illustration of the contacts of the exemplary circuit interrupter, in the form of a circuit breaker, constructed in accordance with the present invention as shown in FIG. 1, shown with arcs formed therebetween based on a DC voltage of a first polarity and the direction toward which the arcs are urged to be extinguished.
Figure 4:
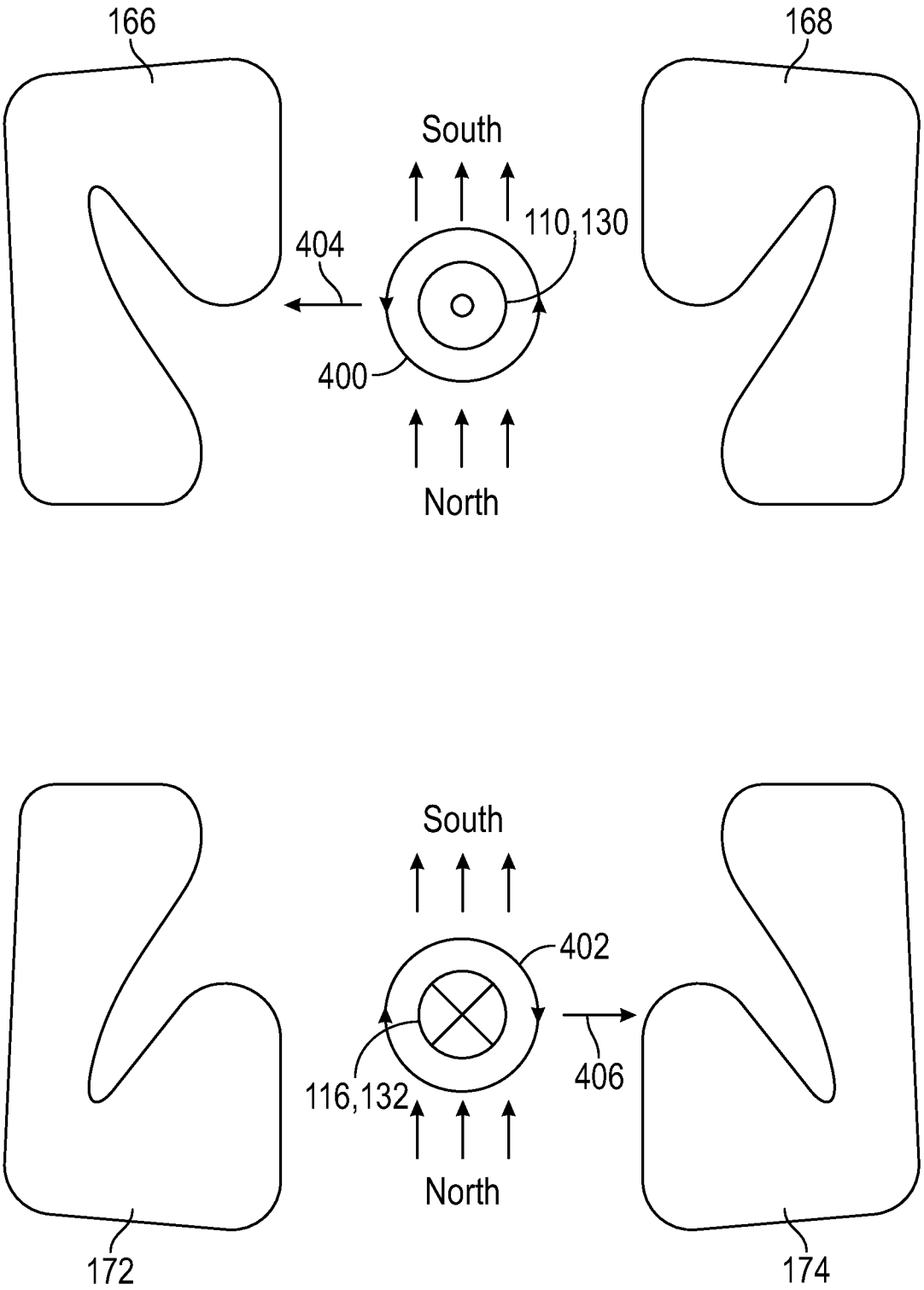
FIG. 4 is a schematic illustration of the contacts of the exemplary circuit interrupter, in the form of a circuit breaker, constructed in accordance with the present invention as shown in FIG. 1, shown with arcs formed therebetween based on a DC voltage of a second polarity, and the direction toward which the arcs are urged to be extinguished.

Turning now to FIGS. 3 and 4, shown are schematic top elevational views illustrating the effects of that various magnetic fields created by magnets (180, 182, 184) upon arcs developing between the first set of contacts (110, 130) and the second set of contacts (116, 132).

In FIG. 3, arcs are illustrated developing between first set of contacts (110, 130) and between second set of contacts (116, 132) when the circuit breaker has a first state of charge (e.g., line terminal (112) has a positive charge and load terminal (118) has a negative charge), while in FIG. 4, arcs are illustrated developing between first set of contacts (110, 130) and between second set of contacts (116, 132) when the circuit breaker has a second state of charge opposite to the first state of charge (e.g., line terminal (112) has a negative charge and load terminal (118) has a positive charge).

With respect to the former situation shown in FIG. 3, this state gives rise to an electromagnetic field (300) surrounding the arc created between the first set of contacts (110, 130) in the clockwise direction indicated, and an electromagnetic field (302) surrounding the arc created between the second set of contacts (116, 132) in the counter-clockwise direction indicated. Electromagnetic field (300) interacts with the additive magnetic fields created by the first stationary permanent magnet (182) and the moveable permanent magnet (180) to move arc (300) in the direction illustrated by arrow (304) (i.e., toward second set of arc plates (168)), while electromagnetic field (302) interacts with the additive magnetic fields created by the second stationary permanent magnet (184) and the moveable permanent magnet (180) to move arc (302) in the direction illustrated by arrow (306) (i.e., toward third set of arc plates (172)).

Turning now to FIG. 4, the situation is shown if the polarity flowing through the circuit breaker is reversed. This state gives rise to an electromagnetic field (400) surrounding the arc created between the first set of contacts (110, 130) in the counter-clockwise direction indicated, and an electromagnetic field (402) surrounding the arc created between the second set of contacts (116, 132) in the clockwise direction indicated. Electromagnetic field (400) interacts with the additive magnetic fields created by the first stationary permanent magnet (182) and the moveable permanent magnet (180) to move arc (400) in the direction illustrated by arrow (404) (i.e., toward first set of arc plates (166)), while electromagnetic field (402) interacts with the additive magnetic fields created by the second stationary permanent magnet (184) and the moveable permanent magnet (180) to move arc (402) in the direction illustrated by arrow (406) (i.e., toward fourth set of arc plates (174)).

Thus, with the combination of three permanent magnets (180, 182, 184) oriented in the particular way illustrated, combined with the four sets of arc quenching plates (166, 168, 172, 174) also oriented in the particular way illustrated surrounding the two sets of contacts (110, 130, 116, 132), enhanced arc quenching is provided regardless of the polarity of current flowing through the circuit breaker (100).

The present invention thus provides a circuit interrupter having an arc extinguishing configuration that is polarity independent (in that it functions equally well regardless of the polarity of current through the circuit interrupter) and that is adapted to both inhibit arc creation in the first place and to rapidly extinguish any electrical arc that is indeed created.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A circuit interrupter comprising:

a first set of contacts including a first contact and a second contact, movable into and out of contact with each other;

a second set of contacts including a third contact and a fourth contact, movable into and out of contact with each other;

said first set of contacts connected in series with said second set of contacts;

wherein said first set of contacts is configured to open and close simultaneously with opening and closing of said second set of contacts;

a first arc extinguisher associated with said first set of contacts;

a second arc extinguisher associated with said second set of contacts; and at least three permanent magnets comprising:

a moveable permanent magnet that moves as the first set of contacts and the second set of contacts simultaneously open and close, said moveable magnet generating a moveable magnetic field;

a first stationary permanent magnet associated with said first arc extinguisher, said first stationary magnet generating a first stationary magnetic field, wherein the first stationary magnetic field and the moveable magnetic field are additive with respect to each other; and a second stationary permanent magnet associated with said second arc extinguisher, said second stationary magnet generating a second stationary magnetic field, wherein the second stationary magnetic field and the moveable magnetic field are additive with respect to each other.

2. The circuit interrupter of claim 1 wherein the circuit interrupter comprises a DC circuit interrupter having a DC voltage passing therethrough.

3. The circuit interrupter of claim 2 wherein said first arc extinguisher comprises a first set of arc splitting plates and a second set of arc splitting plates and wherein said second arc extinguisher comprises a third set of arc splitting plates and a fourth set of arc splitting plates.

4. The circuit interrupter of claim 3 wherein when an arc occurs between said first set of contacts, the first stationary magnetic field and the moveable magnetic field urge the arc off of the first set of contacts and toward either the first set of arc splitting plates or the second set of arc splitting plates depending on a polarity of the DC voltage, and when an arc occurs between said second set of contacts, the second stationary magnetic field and the moveable magnetic field urge the arc off of the second set of contacts and toward either the third set of arc splitting plates or the fourth set of arc splitting plates depending on the polarity of the DC voltage.

5. The circuit interrupter of claim 3 wherein said first stationary permanent magnet is positioned between the first set of arc splitting plates and the second set of arc splitting plates.

6. The circuit interrupter of claim 5 further comprising a shield disposed between said first stationary permanent magnet and said first set of contacts.

7. The circuit interrupter of claim 3 wherein said second stationary permanent magnet is positioned between the third set of arc splitting plates and the fourth set of arc splitting plates.

8. The circuit interrupter of claim 7 further comprising a shield disposed between said second stationary permanent magnet and said second set of contacts.

9. The circuit interrupter of claim 1, further comprising a moveable contact arm on which are positioned said first contact and said third contact.

10. The circuit interrupter of claim 9, wherein said moveable contact arm comprises a first end and a second end and said first contact is positioned toward said first end and said third contact is positioned toward said second end.

11. The circuit interrupter of claim 10 wherein said moveable magnet is positioned on said moveable contact arm between said first contact and said third contact.

12. The circuit interrupter of claim 1, wherein said first arc extinguisher comprises a first arc runner positioned in the vicinity of the first set of contacts and said second arc extinguisher comprises a second arc runner positioned in the vicinity of the second set of contacts.

13. The circuit interrupter of claim 1, wherein said circuit interrupter comprises a circuit breaker, and further comprising an overcurrent measurement device configured to open said first set of contacts and said second set of contacts in response to detection of an overcurrent situation.

14. The circuit interrupter of claim 1, further comprising an actuator, manipulation of which is adapted to open and/or close said first set of contacts and said second set of contacts.

15. The circuit interrupter of claim 1, further comprising a housing configured to be detachably connectable to a DIN rail.

16. A DC circuit breaker adapted to selectively interrupt a DC voltage passing therethrough, said DC circuit breaker comprising:

a moveable contact arm having a first end and a second end;

a first set of contacts including a first contact and a second contact, movable into and out of contact with each other, the first contact being positioned on said moveable contact arm toward the first end thereof;

a second set of contacts including a third contact and a fourth contact, movable into and out of contact with each other, the third contact being positioned on said moveable contact arm toward the second end thereof;

said first set of contacts connected in series with said second set of contacts;

wherein said first set of contacts is configured to open and close simultaneously with opening and closing of said second set of contacts by virtue of movement of said moveable contact arm;

a first arc extinguisher associated with said first set of contacts, said first arc extinguisher comprising a first set of arc splitting plates and a second set of arc splitting plates;

a second arc extinguisher associated with said second set of contacts, said second arc extinguisher comprising a third set of arc splitting plates and a fourth set of arc splitting plates; and at least three permanent magnets comprising:

a moveable permanent magnet positioned on said moveable contact arm between said first contact and said third contact, said moveable magnet generating a moveable magnetic field;

a first stationary permanent magnet associated with said first arc extinguisher, said first stationary magnet generating a first stationary magnetic field, wherein the first stationary magnetic field and the moveable magnetic field are additive with respect to each other, and wherein when an arc occurs between said first set of contacts, the first stationary magnetic field and the moveable magnetic field urge the arc off of the first set of contacts and toward either the first set of arc splitting plates or the second set of arc splitting plates depending on a polarity of the DC voltage; and a second stationary permanent magnet associated with said second arc extinguisher, said second stationary magnet generating a second stationary magnetic field, wherein the second stationary magnetic field and the moveable magnetic field are additive with respect to each other, and wherein when an arc occurs between said second set of contacts, the second stationary magnetic field and the moveable magnetic field urge the arc off of the second set of contacts and toward either the third set of arc splitting plates or the fourth set of arc splitting plates depending on the polarity of the DC voltage.

17. The DC circuit breaker of claim 16 wherein said first stationary permanent magnet is positioned between the first set of arc splitting plates and the second set of arc splitting plates and wherein said second stationary permanent magnet is positioned between the third set of arc splitting plates and the fourth set of arc splitting plates.

18. The DC circuit breaker of claim 17 further comprising a first shield disposed between said first stationary permanent magnet and said first set of contacts and a second shield disposed between said second stationary permanent magnet and said second set of contacts.

19. The DC circuit breaker of claim 16, wherein said first arc extinguisher comprises a first arc runner positioned in the vicinity of the first set of contacts and said second arc extinguisher comprises a second arc runner positioned in the vicinity of the second set of contacts.

20. The DC circuit breaker of claim 16 further comprising an overcurrent measurement device configured to open said first set of contacts and said second set of contacts in response to detection of an overcurrent situation.

21. The DC circuit breaker of claim 20, further comprising an actuator, manipulation of which is adapted to open and/or close said first set of contacts and said second set of contacts.

22. The DC circuit breaker of claim 16, further comprising a housing configured to be detachably connectable to a DIN rail.

* * * * *